United States Patent [19]

Cogan et al.

[11] Patent Number: 4,740,353

[45] Date of Patent: Apr. 26, 1988

[54] AUSTENITIC STAINLESS STEEL

[75] Inventors: Edward Cogan; Gedaliahu Engelberg, both of Haifa, Israel

[73] Assignee: Fertilizers & Chemicals Ltd., Israel

[21] Appl. No.: 904,701

[22] Filed: Sep. 8, 1986

Related U.S. Application Data

[63] Continuation-in-part of Ser. No. 881,262, Jul. 2, 1986, abandoned, which is a continuation of Ser. No. 729,428, May 1, 1985, abandoned.

[30] Foreign Application Priority Data

Jun. 4, 1984 [IL] Israel ..... 72001

[51] Int. Cl.[4] ..... C22C 38/42; C22C 38/44

[52] U.S. Cl. ..... 420/49; 420/52; 420/53; 420/582; 420/584

[58] Field of Search ..... 420/49, 52, 53, 582, 420/585; 148/327

[56] References Cited

FOREIGN PATENT DOCUMENTS 1950932 2/1971 Fed. Rep. of Germany ..... 420/49

5377820 7/1978 Japan ..... 420/49

*Primary Examiner*—Deborah Yee

*Attorney, Agent, or Firm*—Steinberg & Raskin

[57] ABSTRACT

New steel alloys which are both austenitic stainless having a Brinell hardness of 200–380.

The new steel alloys consist essentially of the following components in the proportions indicated expressed in weight %:

| | |
|---|---|
| Mo | 3–6 |
| Cu | 0.25–0.35 |
| Si | max 1.5 |
| Mn | max 1 |
| C | 0.12–0.30 |
| Cr | 12–22 |
| Ni | 8–25 |
| Fe | balance |

with the proviso that the relative proportion between Mo and C is governed by the formula weight % Mo - (weight % C×16)=from 1 to 2.5%.

Optionally the new steel alloys may also contain Nb and Ta.

The invention also concerns shaped objects made of any of the new steel alloys.

12 Claims, 1 Drawing Sheet

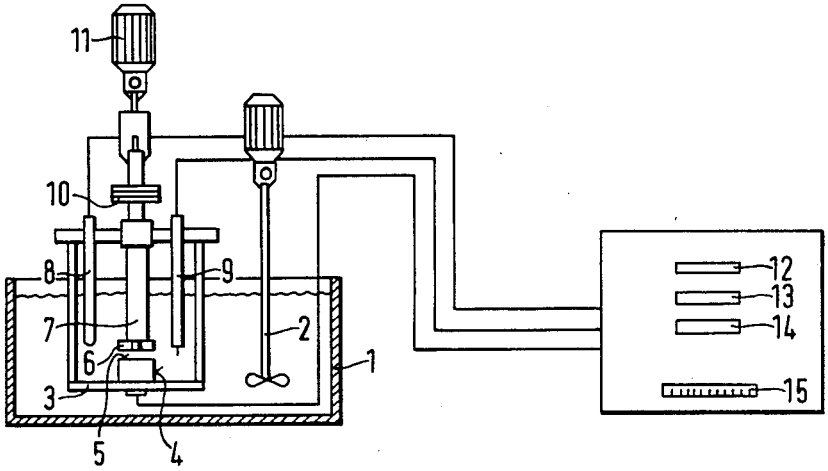
a Fig. 1 b
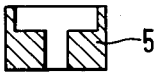
Fig. 2
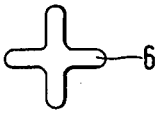
Fig. 3

AUSTENITIC STAINLESS STEEL

This application is a continuation-in-part of U.S. application Ser. No. 06/881,262, filed July 2, 1986, which is a continuation of U.S. application Ser. No. 06/729,428, filed May 1, 1985, both of which are abandoned.

FIELD OF THE INVENTION

The present invention concerns a new austenitic and stainless steel alloy of high resistance to corrosion and erosion.

BACKGROUND OF THE INVENTION AND PRIOR ART

Steel that is highly resistant to corrosion and erosion is required in various industries, a typical example being the production of phosphoric acid by the wet process where some of the moving parts used during digestion of the rock phosphate with sulphuric acid, such as impellers and pumps, have to withstand both corrosion and erosion. This is in particular true for phosphate ores originating from Israel, Jordan, Syria, Spanish Sahara and Mexico and to a somewhat lesser extent for phosphate ore from North Carolina, Kola, Morocco, Tunisia and Togo. The corrosive and erosive conditions encountered during the digestion of these phosphate rocks with sulphuric acid are due to relative high fluoride concentration which may vary from a few hundredths to more than a tenth of a percent; the presence of varying amounts of very hard silicous material, both natural and such that is added to suppress the effect of the free fluoride content; severe cavitation enhanced by foam and gas formation during the dissolution in particular where the ore is not calcined prior to digestion; and an often reducing or at least non-oxidizing medium.

Austenitic steels, which are characterized by a so-called face centered cubic crystal lattice structure in which Fe atoms are located in the centers of the six faces of a cube, are known to have a high corrosion resistance. However, all known austenitic steels are relatively soft having Brinell hardness of 140–180. Consequently their erosion resistance is low and they are unsuitable for making equipment such as pumps and impellers for use in the processing of highly erosive liquid media such as solutions, slurries and suspensions of the kind encountered, for example, in the phosphoric acid industry.

On the other hand, hard stainless steels are known such as, for example, the one known under the designation CD-4 and many others whose Brinell hardness is within the range of 240–310. These known hard steels are, however, not austenitic and they consequently do not have the necessary corrosion resistance required for equipment for use with highly corrosive liquid media. There are also known some special steels such as Hastelloy C (Trademark) which have a fairly good resistance to corrosion but insufficient resistance to erosion, the Brinell hardness of Hastelloy C, for example, being only about 180.

Accordingly, it has hitherto not been possible to make long lasting equipment for use in the processing of highly corrosive and erosive liquid media such as encountered, for example, in the phosphoric acid industry and it is a long standing experience that pumps and impellers used, for example, in the digestion of various types of rock phosphate with sulfuric acid have to be replaced frequently, e.g. every two or three months. There has, accordingly, existed a long-felt need for a new type of steel alloys that will combine the corrosion resistance of austenitic steel with the erosion resistance of hard, non-austenitic stainless steel. However, to date such steel alloys have been unknown.

It is thus the object of the present invention to provide new austenitic and stainless steel alloys of high corrosion and erosion resistance.

GENERAL DESCRIPTION OF THE INVENTION

In accordance with the present invention there is provided an austenitic and stainless steel alloy of high resistance to corrosion and erosion and having a Brinell hardness of 240–380, said steel alloy consisting essentially of the following components in the proportions indicated expressed in weight percent.

| | | |
|---|---|---|
| Molybdenum | (Mo) | 3–6 |
| Copper | (Cu) | 0.25–0.35 |
| Silicium | (Si) | max 1.5 |
| Manganese | (Mn) | max 1 |
| Carbon | (C) | 0.12–0.30 |
| Chromium | (Cr) | 12–22 |
| Nickel | (Ni) | 8–25 |
| Iron | (Fe) | balance |

with the proviso that the relative proportion between Mo and C is governed by the formula weight % Mo - (weight % C×16)=from 1 to 2.5%.

The preferred range of the carbon contents is from 0.15 to 0.27% by weight.

The novel austenitic/stainless steel alloys according to the invention are thus unique in that they combine for the first time corrosion resistance with hardness and erosion resistance.

Accordingly, due to the invention it has now for the first time become possible to make long lasting heavy duty steel equipment such as pumps and impellers that are resistant to the severe corrosion and erosion conditions prevailing, for example, in the phosphoric acid industry and have a plant life of 1½ years or even more.

In the new steel alloys according to the invention Ni is the austenitic former and Cr accounts for the stainless character. Accordingly, the stipulated ranges for the proportions of both these components are essential.

Optionally alloys according to the invention may also contain Niobium (Nb) and/or Tantalum (Ta), each in an amount of about 0.25–0.65% by weight.

The invention also consists in shaped objects made of alloys of the kind specified.

In the following specification the new alloys according to the invention will be designated collectively as CED-9. CED-9 is characterized by a relatively small Cu content—about ⅓ of that in conventional medium alloy austenitic steels of this type—and a relatively high carbon content combined with a relatively high amount of Mo. It is believed that these factors in combination with the stipulated Cr and Ni ranges impart to the CED-9 the desired high resistance to corrosion and erosion.

CED-9 alloy casts according to the invention are prepared by conventional steel foundry techniques. A melt is prepared at a high temperature, e.g. about 1600° C., and after casting the cast is subjected to a heat treatment at about 1000°–1200° C. for at least one hour per inch thickness of the cast, which then is followed by a water quench.

Resistance to corrosion is determined in terms of a current intensity $i_{corr}$ and for explanation of this term reference may be had to Kirk and Othmer, Encyclopedia of Chemical Technology, 3rd Edition, Volume 7, pp 120–121. $i_{corr}$ may be determined by means of a device such as the IMI erosion/corrosion device developed by IMI Institute for Research and Development, Haifa, Israel. Such an instrument measures the corrosion of metals and alloys exposed to a moving slurry, containing suspended solid particles. In such a system a type of corrosion known as erosion-corrosion occurs, in which the corrosion effects are enhanced by mechanical and hydrodynamic factors such as flow regime and its local velocity, erosion, abrasion, impingement, etc.

DESCRIPTION OF DRAWINGS

A tester of the kind specified is illustrated in the accompanying drawings in which:

FIG. 1 is a diagrammatic illustration of the IMI tester; and

FIGS. 2 and 3 are details thereof, drawn to a larger scale.

DESCRIPTION OF EROSION—CORROSION TESTS

The tester here illustrated comprises a vessel 1 which holds a slurry and is fitted with a stirrer 2. Partially immersed in slurry is a perforated cell 3 such that the slurry in vessel 1 and that inside cell 3 communicate with each other. The tester further comprises a specimen holder 4 on which is mounted a recessed metallic specimen 5 which is to be tested. Opposite holder 4 and specimen 5 is mounted a grinder 6 which may assume various different shapes and which fits into the recess in specimen 5, as can be seen from FIGS. 2 and 3. Grinder 6 is mounted on a rotating shaft 7.

Cell 3 is fitted with a standard calomel electrode (SCE) 8 and an auxiliary platinum electrode 9, both immediately adjacent to specimen 5 which latter forms the third electrode of the system.

Shaft 7 is provided with weights 10 and keyed on the shaft is a motor 11 which may be electric or pneumatic.

The three electrodes 5, 8 and 9 are electrically connected to a digital measuring instrument comprising a potentiometer 12, an amperometer 13, an auxiliary electrode control 14 and a polarization potential generator 15.

The instrument employs the polarization resistance technique to determine the instantaneous rate of corrosion on the specimen surface. Potentiometer 12 measures the potential of the specimen and amperometer 13 the corrosion current which flows between the specimen 5 and the auxiliary electrode 9 when a small polarization potential is applied by means of generator 15, which potential is set with respect to the reference electrode as equal to the corrosion potential $E_{corr}$ (see Kirk & Othmer loc sit).

With the aid of this tester the $i_{corr}$ and the annual rate of corrosion expressed in terms of diminishing dimension of the test specimen in mm per year - mm/y, were determined in respect of two conventional steels 316 Stst and Uranus B-6 and in respect of a CED-9 alloy according to the invention. The readings were taken under three different conditions: low weight (49 kg/cm$^2$) at 25 rpm and 100 rpm; and high weight (78 kg/cm$^2$) at 100 rpm. The results are given in the following Table 1:

TABLE 1

| | 316 Stst | | Uranus B-6 | | CED | |
|---|---|---|---|---|---|---|
| Final electrode potential, in volts | 0.05 | | 0.10 | | 0.19 | |
| Corrosion Rate | $i_{corr}$ | mm/y* | $i_{corr}$ | mm/y* | $i_{corr}$ | mm/y* |
| 25 rpm; low wgt | 0.78 | 8.2 | 0.02 | .22 | 0.003 | .03 |
| 100 rpm; low wgt | 0.48 | 5.1 | 0.05 | .53 | 0.04 | .44 |
| 100 rpm; high wgt | 0.59 | 6.2 | 0.07 | .74 | 0.04 | .40 |

*Calculated from $i_{corr}$

It is seen from Table 1 that CED-9 is the only one that has a low corrosivity, i.e. low values of $i_{corr}$ and a small rate of erosion.

DESCRIPTION OF SOME SPECIFIC EMBODIMENTS

Some typical alloys according to the invention were tested in a phosphoric acid plant in Israel as well as in the laboratory by the above-described testing method, with slurries taken from the plant. Similar tests were also performed with related alloys but not fulfilling the % Mo - (16×% C) proviso stipulated in accordance with the invention. The results of these tests are given in the following Table 2 in which Examples 1–6 were performed with steel alloys according to the invention, showing good resistance to wear, while Examples 7–9 which show poor resistance to wear were performed with similar steel alloys in which, however, the % Mo - (16×% C) proviso is not fulfilled so that they are not within the scope of the invention. The criticality of the % Mo (16×% C) stipulation is thus demonstrated.

TABLE 2

| EXAMPLE | C % | Mo % | % Mo-(16 × C)* | Brinell Hardness | Lifetime in plant and/or annual rate of corrosion in lab |
|---|---|---|---|---|---|
| 1. | 0.18 | 4.5 | 1.62 | 320 | plant 553 days (.28 mm/y lab) |
| 2. | 0.12 | 3.6 | 1.68 | 310 | in lab .30 mm/y |
| 3. | 0.22 | 4.7 | 1.18 | 280 | plant 513 days (.33 mm/y lab) |
| 4. | 0.19 | 4.7 | 1.73 | 270 | plant 235 days (high $F^-$) |
| 5. | 0.1 | 3.72 | 2.12 | 250 | plant 345 days |
| 6. | 0.15 | 4.7 | 2.3 | 245 | in lab 45 mm/y |
| 7. | 0.22 | 2.8 | −.72 | 220 | plant 29 days |
| 8. | 0.28 | 3.7 | −.78 | 255 | in lab .82 mm/y |
| 9. | 0.30 | 3.3 | −1.5 | 320 | plant 16 days |

*Other components in each case: Ni 25%, Cr 20%, Cu 0.3%, Nb 0.6%, Mn 1% max, Si 1.5 max, Fe balance

We claim:

1. An austenitic stainless steel alloy having a high resistance to erosion and corrosion and having a Brinell hardness of 200–380, said steel alloy consisting essentially of the following components in the proportions indicated expressed in weight percent:

| | |
|---|---|
| Mo | 3–6 |
| Cu | 0.25–0.35 |
| Si | max 1.5 |
| Mn | max 1 |
| C | 0.12–0.30 |
| Cr | 12–22 |
| Ni | 8–25 |
| Fe | balance |

with the proviso that the relative proportion between Mo and C is governed by the formula weight % Mo - (weight % C×16)=from 1 to 2.5%.

2. An alloy according to claim 1 also containing Nb in a proportion of about 0.25–0.65% by weight.

3. An alloy according to claim 1 also containing Ta in a proportion of 0.25–0.55% by weight.

4. An austenitic stainless steel alloy having a high resistance to erosion and corrosion and having a Brinell hardness of 200–380, said steel alloy consisting essentially of the following components in the proportions indicated expressed in weight percent:

| | |
|---|---|
| Mo | 3–6 |
| Cu | 0.25–0.35 |
| Si | max 1.5 |
| Mn | max 1 |
| C | 0.12–0.30 |
| Cr | 12–22 |
| Ni | 8–25 |
| Nb | 0.25–0.65 |
| Ta | 0.25–0.65 |

-continued

| | |
|---|---|
| Fe | balance |

with the provision that the relative proportion between Mo and C is governed by the formula weight % Mo - (weight % C×16)=from 1 to 2.5%.

5. A shaped object made of an alloy according to claim 1.

6. A shaped object made of an alloy according to claim 2.

7. A shaped object made of an alloy according to claim 3.

8. A shaped object made of an alloy according to claim 4.

9. The alloy according to claim 1, wherein the proportion of C is 0.15–0.27% by weight.

10. The alloy of claim 4, wherein the proportion of C is 0.15–0.27% by weight.

11. A shaped object made of an alloy according to claim 9.

12. A shaped object made of an alloy according to claim 10.

* * * * *